US005853940A

United States Patent [19]

Kido et al.

[11] Patent Number: 5,853,940

[45] Date of Patent: Dec. 29, 1998

[54] TONER FOR DEVELOPING ELECTROSTATIC LATENT IMAGE

[75] Inventors: Kenichi Kido; Tetsuo Sano; Yoshitaka Sekiguchi, all of Amagasaki; Hiroyuki Fukuda, Kobe, all of Japan

[73] Assignee: Minolta Co., Ltd., Osaka, Japan

[21] Appl. No.: 66,737

[22] Filed: Apr. 27, 1998

Related U.S. Application Data

[62] Division of Ser. No. 948,415, Oct. 9, 1997, Pat. No. 5,776, 647.

[30] Foreign Application Priority Data

| | | | |
|---|---|---|---|
| Mar. 4, 1919 | [JP] | Japan | 9-049120 |
| Mar. 4, 1997 | [JP] | Japan | 9-049121 |
| Mar. 4, 1997 | [JP] | Japan | 9-049123 |

[51] Int. Cl.[6] ..... G03G 9/087; G03G 9/097

[52] U.S. Cl. ..... 430/110; 430/109; 430/111

[58] Field of Search ..... 430/109, 110, 430/111

[56] References Cited

U.S. PATENT DOCUMENTS 5,776,647 7/1998 Kido et al. ..... 430/110

*Primary Examiner*—Roland Martin
*Attorney, Agent, or Firm*—McDermott Will & Emery

[57] ABSTRACT

The present invention relates to a toner comprising a specific binder resin, a specific polyethylene wax and a specific polypropylene wax. The present invention further relates to a toner which comprises a binder resin including a specific first resin and a specific second resin.

13 Claims, No Drawings

TONER FOR DEVELOPING ELECTROSTATIC LATENT IMAGE

This is a Divisional of U.S. patent application Ser. No. 08/948,415, filed Oct. 9, 1997, now U.S. Pat. No. 5,776,647.

BACKGROUND OF THE INVENTION

1. Field of the Invention

The present invention relates to a toner for developing electrostatic latent images, and specifically relates to a toner for developing electrostatic latent images for use in electrophotographic apparatus of the digital type.

2. Description of the Related Art

Conventional image forming apparatuses are generally analog type image forming apparatuses such as used in copiers and the like wherein a document is illuminated by a light source and the light reflected from said document irradiates the surface of a photosensitive member so as to form an electrostatic latent image on the surface of said photosensitive member. Image forming apparatuses of the digital type are known wherein digitally written electrostatic latent image is developed by supplying a developer containing a toner to said latent image. Digital type image forming apparatuses have been practicalized in the forms of electrophotographic type facsimile apparatuses, digital copiers which form images based on image information read by an image reader, and printers using the output of computer terminals.

In image forming apparatuses of the digital type, an electrostatic latent image is formed in dot units on the surface of a photosensitive member by digitally writing image data via irradiation of said surface by a laser beam or the like, this latent image is developed by a toner, and the obtained toner image is transferred onto a recording member and fused thereon to form a recorded image. The toner used in such digital type processes must have very slight thickening of the dots due to toner breakdown during transfer and heat-fixing, i.e., must have excellent dot reproducibility. When dot reproducibility is poor, image quality is reduced due to low density halftone nonreproducibility and toner breakdown.

In recent years image forming apparatuses loaded with auto document feeder and duplex copying devices have come to be used in conjunction with progress toward high-speed, multifunctional image forming apparatuses. Image quality is reduced smearing and soiling of an image when the image surface is rubbed by a roller during transport or reverse side copying in such apparatuses.

This type of toner must have excellent anti-offset characteristics to avoid image soiling due to offset developing during heat fixing of the toner. Although the addition of wax to the toner as a separation agent is effective in improving anti-offset characteristics, the wax may become free during toner manufacture, and free wax is a cause of filming of the photosensitive member, and free wax adhered to the surface of the photosensitive member forms nodules to which toner components adhere and form black spots.

SUMMARY AND OBJECTS OF THE INVENTION

An object of the present invention is to eliminate the previously described disadvantages by providing a toner for developing electrostatic latent images which eliminates said disadvantages causing reduction of image quality.

Another object of the present invention is to provide a toner for developing electrostatic latent images having excellent anti-offset characteristics.

A further object of the present invention is to provide a toner for developing electrostatic latent images which eliminates the problems of filming and black spots.

A still further object of the present invention is to provide a toner for developing electrostatic latent images having excellent dot reproducibility.

The present invention relates to a toner comprising a binder resin having an acid value of 5 to 50 KOHmg/g; a colorant; a polyethylene wax having a melt viscosity of 1,000 to 8,000 cps at 160° C. and a softening-point of 130° to 150° C.; and a polypropylene wax having a melt viscosity of 50 to 300 cps at 160° C., a softening point of 130° to 160° C. and an acid value of 1 to 20 KOHmg/g.

The present invention further relates to a toner comprising a binder resin and a colorant, wherein said binder resin includes a first resin having a glass transition temperature of 50° to 75° C. and a softening point of 95° to 120° C., and a second resin having a glass transition temperature of 50° to 75° C. and a softening point of 130° to 160° C., said first resin being a linear polyester resin comprising a bivalent alcohol component and a bivalent carboxylic acid component, and said second resin comprising a resin produced by dual reactions of a condensation polymerization and a radical polymerization using a monomer of polyester resin, a monomer of vinyl resin and a dual-reactive monomer.

DESCRIPTION OF THE PREFERRED EMBODIMENTS

The present invention relates to a toner comprising a binder resin having an acid value of 5 to 50 KOHmg/g; a colorant; a polyethylene wax having a melt viscosity of 1,000 to 8,000 cps at 160° C. and a softening point of 130° to 150° C.; and a polypropylene wax having a melt viscosity of 50 to 300 cps at 160° C., a softening point of 130° to 160° C. and an acid value of 1 to 20 KOHmg/g.

The present invention further relates to a toner comprising a binder resin and a colorant, wherein said binder resin includes a first resin having a glass transition temperature of 50° to 75° C. and a softening point of 95° to 120° C., and a second resin having a glass transition temperature of 50° to 75° C. and a softening point of 130° to 160° C., said first resin being a linear polyester resin comprising a bivalent alcohol component and a bivalent carboxylic acid component, and said second resin comprising a resin produced by dual reactions of a condensation polymerization and a radical polymerization using a monomer of polyester resin, a monomer of vinyl resin and a dual-reactive monomer.

In the present invention, it is desirable that the binder resin have an acid value of 5 to 50 KOHmg/g, and preferably 10 to 40 KOHmg/g. Among resins having such an acid value, polyester resins are desirable. Use of resin having such an acid value improves dispersability of the polyethylene wax and polypropylene wax described later, and eliminates the problem of filming of the photosensitive member by suppressing the production of wax separation. When the acid value is less than 5 KOHmg/g, the aforesaid effectiveness is reduced, whereas when the acid value exceeds 50 KOHmg/g, toner charge stability is lost relative to environmental fluctuations, and particularly humidity fluctuation.

The polyester resin used in the present invention may be a polyester resin obtained by a condensation polymerization of a polyvalent alcohol component and a polyvalent carboxylic acid component.

Examples of useful bivalent alcohol components among the aforesaid polyvalent alcohol components include bisphenol-A alkylene oxide adducts such as polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane, polyoxyethylene(2,0)-2,2-bis(4-hydroxyphenyl)propane and the like, ethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polytetramethylene glycol, bisphenol-A, bisphenol-A with added hydrogen and the like.

Examples of useful trivalent and above alcohol components include sorbitol, 1,2,3,6-hexanetetrol, 1,4-sorbitane, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene and the like.

Examples of useful bivalent carboxylic acid components among the aforesaid polyvalent carboxylic acid component include maleic acid, fumaric acid, citraconic acid, itaconic acid, glutamic acid, phthalic acid, isophthalic acid, terephthalic acid, cyclohexane dicaroboxylic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, isooctenylsuccinic acid, n-octylsuccinic acid, isooctylsuccinic acid, and acid anhydrides or low-molecular alkyl esters thereof.

Examples of useful trivalent and above carboxylic acid components include 1,2,4-benzenetricarboxylic acid (trimellitic acid), 1,2,5-benzenetricarboxylic acid, 2,5,7-naphthalenetricarboxylic acid, 1,2,4-napthalenetricarboxylic acid, 1,2,4-butanetricarboxylic acid, 1,2,5-hexanetricarboxylic acid, 1,3-dicarboxyl-2-methyl-2-methylenecarboxy propane, 1,2,4-cyclohexanetricarboxylic acid, tetra(methylecarboxyl)methane, 1,2,7,8-octane tetracarboxylic acid, pyromellitic acid, Empol trimer acid, and acid anhydrides and low-molecular alkyl esters thereof.

The binder resin used in the present invention may be a resin obtained by parallel reactions in the same vessel comprising a radical polymerization reaction of vinyl resin and a condensation polymerization reaction of a polyester resin using a raw monomer of polyester resin, a raw monomer of vinyl resin and a dual-reactive monomer. The dual-reactive monomer is a raw monomer that is able to use the dual reactions of the condensation polymerization and the radical polymerization. That is, the dual-reactive monomer has a carboxy group for the condensation polymerization and a vinyl group for the radical polymerization, e.g., fumaric acid, maleic acid, acrylic acid, methacrylic acid and the like.

The raw monomers of the polyester resin may have the aforesaid polyvalent alcohol component and polyvalent carboxylic acid component.

Examples of useful raw monomers of vinyl resin include styrene or styrene derivatives such as styrene, o-methylstyrene, m-methylstyrene, p-methylstyrene, α-methylstyrene, p-ethylstyrene, 2,4-dimethylstyrene, p-tert-butylstyrene, p-chlorostyrene and the like; ethylene unsaturated monoolefins such as ethylene, propylene, butylene, isobutylene and the like; alkyl ester methacrylates such as methylmethacrylate, n-propylmethacrylate, isopropylmethacrylate, n-butylmethacrylate, isobutylmethacrylate, t-butylmethacrylate, n-pentylmethacrylate, isopentylmethacrylate, neopentylmethacrylate, 3-(methyl)butylmethacrylate, hexylmethacrylate, octylmethacrylate, nonylmethacrylate, decylmethacrylate, undecylmethacrylate, dodecylmethacrylate and the like; alkyl ester acrylates such as methylacrylate, n-propylacrylate, isopropylacrylate, n-butylacrylate, isobutylacrylate, t-butylacrylate, n-pentylacrylate, isopentylacrylate, neopentylacrylate, 3-(methyl) butylacrylate, hexylacrylate, octylacrylate, nonylacrylate, decylacrylate, undecylacrylate, dodecylacrylate and the like; and acrylonitile, maleic acid ester, itaconic acid ester, vinylchloride, vinyl acetate, vinylbenzoate, vinylmethylethyl ketone, vinylhexyl ketone, vinylmethyl ether, vinylethyl ether, vinylisobutyl ether and the like. Examples of useful polymerization initiators when polymerizing the raw monomers of vinyl resin include azo and diazo polymerization initiators such as 2,2'-azobis(2,4-dimethylvaleronitrile, 2,2'-azobisisobutylonitrile, 1,1'-azobis(cyclohexane-1-carbonitrile), 2,2'-azobis-4-methoxy-2,4-dimethylvaleronitrile and the like; and perioxide polymerization initiators such as benzoylperoxide, methylethylketone peroxide, isopropyl peroxycarbonate, lauroyl peroxide and the like.

In the present invention, it is desirable that the binder resin comprise two types of resins having different softening points so as to improve fixing characteristics, and to improve anti-offset characteristics. That is, it is desirable that a first resin having a softening point of 95° to 120° C. is used to improve fixing characteristics, and a second resin having a softening point of 130° to 160° C. is used to improve anti-offset characteristics. In this case, when the softening point of the first resin is less than 95° C., anti-offset characteristics are reduced and cause a reduction in dot reproducibility, and when the softening point is in excess of 120° C., there is inadequate improvement of fixing characteristics. When the softening point of the second resin is less than 130° C., there is inadequate improvement of anti-offset characteristics, and when the softening point is in excess of 160° C., fixing characteristics are reduced. From these perspectives, therefore, it is desirable that the softening point of the first resin is 100° to 115° C., and the softening point of the second resin is 135° to 155° C. It is further desirable that the glass transition temperatures of the first and second resins is 50° to 75° C., and preferably 55° to 70° C. When the glass transition temperature is less than 55° C., the toner has inadequate heat resistance, whereas when the glass transition temperature is higher than 70° C., pulverization characteristics during manufacture are lowered and cause a reduction in production efficiency.

It is desirable that the aforesaid first resin should be a polyester resin produced by condensation polymerization of the aforesaid polyvalent alcohol component and polyvalent carboxylic acid component, and it is particularly desirable that the polyester resin has bisphenol-A alkylene oxide additive as a main polyvalent alcohol component, and at least one polyvalent carboxylic acid monomer selected from the group consisting of terephthalic acid, fumaric acid, dodecenylsuccinic acid, benzenetricarboxylic acid as a main polyvalent carboxylic acid component. It is further desirable that the first resin is a linear polyester resin comprising only a bivalent alcohol component and a bivalent carboxylic acid component. When a linear polyester resin is used, a greater degree of polymerization is achieved even when the resins have the same softening points compared to when using trivalent carboxylic acid components, thereby improving strength.

Polyester resin produced by condensation polymerization of the aforesaid polyvalent alcohol component and polyvalent carboxylic acid component may be used as the second resin. For example, a polyester resin may be produced using bisphenol-A alkylene oxide as a main polyvalent alcohol component, at least one polyvalent carboxylic acid monomer selected from the group consisting of terephthalic acid, fumaric acid, dodecenylsuccinic acid, benzenetricarboxylic acid as a main polyvalent carboxylic acid component.

From the perspectives of improving wax dispersibility, toner strength, fixing characteristics, and anti-offset characteristics is desirable that the second resin should be the resin obtained by parallel reactions in the same vessel comprising the radical polymerization reaction of vinyl resin and the condensation polymerization reaction of a polyester resin using the raw monomer of polyester resin, the raw monomer of vinyl resin and the dual-reactive monomer. The vinyl resin content of the second resin is desirably 5 to 40 percent-by-weight, and preferably 10 to 35 percent-by-weight (hereinafter percent-by-weight is abbreviated to wt %), and the polyester resin content is desirably 60 to 95 wt %, and preferably 65 to 90 wt %. When the vinyl resin content is less that 5 wt %, polyethylene wax dispersibility is reduced, and toner fixing strength is reduced. When the vinyl resin content exceeds 40 wt %, polypropylene wax dispersibility is reduced, and anti-offset characteristics and toner strength are reduced, and lead to low negative charge level in the toner.

The weight ratio of the first resin to the second resin is desirably 7:3 to 2:8, and preferably 6:4 to 3:7. Using first and second resins within the aforesaid ranges produces excellent dot reproducibility by minimizing toner breakdown during fixing, and maintains excellent fixing characteristics even in image forming apparatuses operating at low and high speeds by having excellent low temperature fixing characteristics. Furthermore, excellent dot reproducibility is maintained even in the case of forming images on both sides of a sheet (i.e., passing through the fixing device twice). When the ratio of the first polyester resin is less than the aforesaid range, low temperature fixing characteristics are inadequate and a broad range of fixing characteristics cannot be assured. When the ratio of the second polyester resin is less than the aforesaid range, anti-offset characteristics are reduced, and dot reproducibility is reduced due to toner breakdown during fixing.

The softening point was determined using a flow tester (model CFT-500; Shimazu Seisakusho); The softening point was designated as the temperature corresponding to ½ the height from the flow start point to the flow end point when a 1 $cm^3$ sample was melted under conditions of die pore size of 1 mm diameter by 1 mm length, pressure of 20 $kg/cm^2$, and temperature rise rate of 6° C./min. The glass transition temperature was measured using a differential scanning calorimeter(model DCS-200; Seiko Denshi) and alumina as a reference; a 10 mg sample was heated from 20°–120° C. with a temperature rise rate of 10° C./min, and the shoulder value at the main endothermic peak was designated the glass transition temperature. The acid value of the resin is the value calculated from the uptake of a N/10 sodium hydroxide/alcohol solution by titrating a previously standardized N/10 sodium hydroxide/alcohol solution using 0.1% bromothymol blue and phenol red mixed indicator with 10 mg of sample material dissolved in 50 ml toluene.

In the present invention, carbon black is used as a colorant; the amount of carbon black used is desirably 6 to 12 parts-by-weight (hereinafter "parts-by-weight" is abbreviated as "pbw"), and preferably 7 to 10 pbw, relative to 100 pbw of binder resin. When the carbon black content is less than 6 pbw, the toner has insufficient degree of blackness. When the carbon black content exceeds 12 pbw, the toner charge is reduced, thereby readily causing the disadvantages of toner fog and spillage. From the perspective of safety, the carbon black used will have a mean primary particle size of 40 nm or less, and preferably 10 to 40 nm, and more preferably 15 to 35 nm. When using the aforesaid polyester resin as a binder resin, it is desirable to use an acidic carbon black having a pH value of 1 to 6 to improve dispersibility.

The waxes used in the toner of the present invention are a polyethylene wax having a melt viscosity of 1,000 to 8,000 cps at 160° C. and a softening point of 130° to 150° C., and a polypropylene wax having a melt viscosity of 50 to 300 cps at 160° C., a softening point of 130° to 160° C. and an acid value of 1 to 20 KOHmg/g. The melt viscosity of these waxes were measured using a Brookfield viscometer. The problems of offset developing and reduced image quality (smearing) caused by offset can be eliminated without producing new disadvantages such as filming by means of the aforesaid added content of two types of waxes. That is, the use of polyethylene wax having the previously mentioned melt viscosity and softening point improves smear characteristics by reducing the friction coefficient of the fixed image surface, and eliminates the problem of filming of the photosensitive member by minimizing the amount of free polyethylene wax particles released during manufacture and mixed in the toner. Furthermore, the use of polypropylene wax having the previously mentioned melt viscosity and softening point improves anti-offset characteristics, and minimizes the production of polypropylene wax separation. Since anti-offset characteristics are reduced when the acid value of the polypropylene wax is too high, an acid value of 3 to 15 KOHmg/g is desirable.

In the present invention, the aforesaid polypropylene wax is desirably a molten blend of a non-oxidized polypropylene wax and oxidized polypropylene wax having an acid value of 20 to 70 KOHmg/g. In this instance, the content of oxidized propylene wax in the polypropylene blend is adjusted to 3 to 15 wt %, and the ultimate acid value of the propylene wax is adjusted to 1 to 20 KOHmg/g, and preferably 3 to 15 KOHmg/g. The aforesaid polypropylene wax improves dispersibility in the polyester resin having the previously mentioned acid value, and suppresses the production of wax separation. Furthermore, the polypropylene wax produced by the aforesaid molten blend is desirably adjusted so as to have a volume-average particle size of 10 to 20 $\mu$m for use in toner manufacture.

The additive amount of polyethylene wax is desirably 0.1 pbw or more, and preferably 0.3 pbw or more relative to 100 pbw of binder resin, and the additive amount of polypropylene wax is desirably 0.5 pbw or more, and preferably 1 pbw or more, relative to 100 pbw of binder resin, and the total additive amount of both said waxes is desirably less than 5 pbw, and preferably less than 4.5 pbw, relative to 100 pbw of binder resin. When the additive amount of said respective waxes is too low, the effectiveness desired by adding said waxes is inadequately achieved. When the total additive amount of said waxes exceeds 5 pbw, the toner will have reduced flow characteristics of toner intermediate particles (coarsely pulverized particles, finely pulverized particles and the like) during the manufacturing stage, and manufacturing efficiency is reduced due to adhesion of said intermediate particles on the walls of the manufactured devices or shipping devices.

Negative charge controllers, magnetic powder and like additives may be added to the toner of the present invention as necessary.

Examples of useful negative charge-controllers include azo dye chrome complex salts S32, 33, 34, 35, 37, 38, 40 (Orient Chemical Industries), Spiron black TRH, BHH (Hodogaya Chemicals), Kayaset black T-22, 004 (Nippon Kayaku), copper phthalocyanine dye S-39 (Orient Chemical Industries), chrome salicylate complex salt E-81, 82 (orient Chemical Industries), zinc salicylate complex salt E-84 (Orient Chemical Industries), Aluminum salicylate complex salt E-86 (Orient Chemical Industries), calix arene compound E-89 (Orient Chemical Industries) and the like. The negative charge controller content is desirably 0.5 to 5 pbw, and preferably 1 to 3 pbw relative to 100 pbw of binder resin. When the negative charge controller content is less than 0.5 pbw, inadequate effectiveness is achieved, whereas when the content exceeds 5 pbw, the carrier readily becomes spent. It is desirable that the negative charge controller used in the present invention has the chemical structural formula (A) shown below.

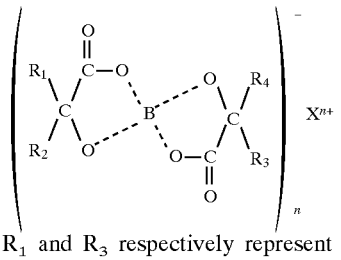

(A)

(Wherein $R_1$ and $R_3$ respectively represent substituted or non-substituted aryl group, $R_2$ and $R_4$ respectively represent hydrogen atom, alkyl group, substituted or non-substituted aryl group, and X represents a cation. In the equation, n is an integer of either 1 or 2.)

Use of the aforesaid boron compound improves toner charge stability and toner charge rise characteristics. The aforesaid boron compound provides excellent safety inasmuch as it does not contain heavy metal. Examples of usable cations represented by X in the aforesaid structural formula (A) include alkali metal ions such as lithium, potassium and the like, alkali earth metal ions such as magnesium, calcium and the like, hydrogen ion, ammonium ion, iminium ion, phosphonium ion and the like.

Magnetic powder or the like may be added to the toner of the present invention as necessary. Examples of useful magnetic powders include well-known fine magnetic particles such as ferrite, magnetite, iron and the like, and may be added from the perspective of preventing airborne dispersion of the toner; The amount of added magnetic powder is desirable 0.5 to 10 pbw, preferably 0.5 to 8 pbw, and more preferably 1 to 5 pbw, relative to 100 pbw of binder resin. When the amount of added magnetic powder exceeds 10 pbw, developing characteristics are reduced due to the strengthening of the magnetic flux force exerted the developer carrying member (within the magnet roller) on the toner.

The toner of the present invention may have an exterior coating of inorganic microparticles on its surface. The toner and inorganic microparticles may be subjected to mechanical mixing to achieve the surface coating. Examples of useful inorganic microparticles include silica particles, titanium dioxide particles, alumina particles, magnesium fluoride particles, silicon carbide particles, boron carbide particles, titanium carbide particles, zirconium carbide particles, boron nitride particles, titanium nitride particles, zirconium nitride particles, magnetite particles, molybdenum disulfide particles, barium titanate particles, strontium titanate particles, aluminum stearate particles, magnesium stearate particles, zinc stearate particles and the like used individually or in combinations of two or more. It is desirable that silica particles and titanium dioxide particles are used in combination for the exterior coating process. The amount of added inorganic microparticles is desirably 0.05 to 2 wt %, and preferably 0.1 to 1 wt % relative to the toner. The addition of the inorganic microparticles in the aforesaid amount improves flow characteristics without loss of environmental stability of the developer. Furthermore, it is desirable from the perspective of improved environmental stability that the aforesaid inorganic microparticles are subjected to hydrophobic processing using, for example, silane coupling agent, titanium coupling agent, higher fatty acids, silicone oil and the like. It is desirable that the aforesaid inorganic microparticles have a BET specific surface area of 80 to 180 $m^2/g$. The use of inorganic microparticles having the aforesaid BET specific surface ratio improves flow characteristics by allowing an increased amount of additive without loss of environmental stability compared to the use of inorganic microparticles having a BET specific surface area of 200 $m^2/g$ or higher relative to the fine toner particles having a mean particle size of 5 to 9 $\mu$m which reduce flow characteristics. Not only are flow characteristics improved, but also dot reproducibility is improved by improving the transfer characteristics when transferring a toner image formed on the surface of a photosensitive member to a recording medium such as a recording sheet or the like.

The toner of the present invention may be used in a two-component developer together with a carrier, or in a monocomponent developer without a carrier. The carrier used in a two-component developer may be a well-known conventional carrier.

The present invention is described by way of examples below, but is not limited to these examples.

PRODUCTION OF LINEAR POLYESTER RESINS L1–L3

Polyoxypropylene(2,2)-2,2-bis(4-hydroxyphenyl) propane, polyoxyethylene(2,2)-2,2-bis(4-hydroxyphenyl) propane, anhydrous isododecenylsuccinic acid, terephthalic acid, and fumaric acid were combined to achieve a weight ratio of 82:77:16:32:30. The mixture was introduced into a four-mouth flask to which a reflux condenser, nitrogen gas tube, thermometer, and mixing device were attached, then dibutyl tin oxide was added as a polymerization initiator. The material was heated in a mantle heater under a nitrogen atmosphere and reacted by mixing at 220° C. to obtain polyester resins L1–L3. The obtained polyester resin L1 had a softening point of 110° C., glass transition temperature of 60° C., and acid value of 17.5 KOHmg/g. The obtained polyester resin L2 had a softening point of 100° C., glass transition temperature of 52° C., and acid value of 19.3 KOHmg/g. The obtained polyester resin L3 had a softening point of 118° C., glass transition temperature of 73° C., and acid value of 15.9 KOHmg/g.

PRODUCTION OF POLYESTER RESIN L4

Polyoxypropylene(2,2)-2,2-bis(4-hydroxyphenyl) propane, polyoxyethylene(2,2)-2,2-bis(4-hydroxyphenyl) propane, terephthalic acid, and anhydrous 1,2,4-benzenetricarboxylic acid were combined to achieve a weight ratio of 73:30:45:3. The mixture was introduced into a four-mouth flask to which a reflux condenser, nitrogen gas tube, thermometer, and mixing device were attached, then dibutyl tin oxide was added as a polymerization initiator. The material was heated in a mantle heater under a nitrogen atmosphere and reacted by mixing at 220° C. The obtained polyester resin L4 had a softening point of 111.5° C., glass transition temperature of 70° C., and acid value of 19.3 KOHmg/g.

PRODUCTION OF POLYESTER RESINS H1–H3

Styrene and 2-ethylhexylacrylate were combined at a weight ratio of 17:3.2, and dicumyl peroxide was introduced via a titration rod as a polymerization initiator. Polyoxypropylene(2,2)-2,2-bis(4-hydroxyphenyl) propane, polyoxyethylene(2,2)-2,2-bis(4-hydroxyphenyl) propane, anhydrous isododecenylsuccinic acid terephthalic acid, anhydrous 1,2,4-benzenetricarboxylic acid, and acrylic acid were combined to achieve a weight ratio of 42:11:11:11:8:1, and the mixture was introduced into a four-mouth flask to which a reflux condenser, nitrogen gas tube, thermometer, and mixing device were attached, then dibutyl tin oxide was added as a polymerization initiator. The material was mixed in a mantle heater under a nitrogen atmosphere at 135° C. as the styrene/2-ethylhexylacrylate solution was titrated in via the titration rod, and thereafter the temperature was elevated and the materials were reacted at 230° C. to obtain polyester resins H1–H3. The obtained polyester resin H1 had a softening point of 150° C., glass transition temperature of 62° C., and acid value of 24.5 KOHmg/g. The obtained polyester resin H2 had a softening point of 136° C., glass transition temperature of 52° C., and acid value of 26.3 KOHmg/g. The obtained polyester resin H3 had a softening point of 158° C., glass transition temperature of 73° C., and acid value of 21.4 KOHmg/g. The polyester resins H1–H3 were resins containing polyester resin and vinyl resin.

PRODUCTION OF POLYESTER RESIN H4

Polyoxypropylene(2,2)-2,2-bis(4-hydroxyphenyl) propane, polyoxyethylene(2,2)-2,2-bis(4-hydroxyphenyl) propane, anhydrous isododecenylsuccinic acid, terephthalic acid, and anhydrous 1,2,4-benzenetricarboxylic acid were combined to achieve a weight ratio of 73:30:18:25:3. The mixture was introduced into a four-mouth flask to which a reflux condenser, nitrogen gas tube, thermometer, and mixing device were attached, then dibutyl tin oxide was added as a polymerization initiator. The material was heated in a mantle heater under a nitrogen atmosphere and reacted by mixing at 220° C. The obtained polyester resin H4 had a softening point of 154° C., glass transition temperature of 64° C., and acid value of 20.4 KOHmg/g.

PRODUCTION OF MELT BLEND POLYPROPYLENE WAX A

Non-oxidized polypropylene wax having an acid value of 0 KoHmg/g (Biscol 550P; Sanyo Kasei Kogyo) and oxidized polypropylene wax having an acid value of 52 KOHmg/g (Yumex 1010; Sanyo Kasei Kogyo) were mixed at weight ratio of 92:8 and subjected to fusion kneading, then cooled and pulverized to obtain melt blend polypropylene wax A having an acid value of 4.0 KOHmg/g, melt viscosity of 205 cps at 160° C., and softening point of 150° C.

PRODUCTION OF MELT BLEND POLYPROPYLENE WAX B

Melt blend polypropylene wax B was produced in the same manner as the aforesaid melt blend polypropylene wax A with the exception that the weight ratio of non-oxidized polypropylene wax to oxidized polypropylene wax was 87:13. Melt blend polypropylene wax B had an acid value of 6.8 KOHmg/g, melt viscosity of 210 cps at 160° C., and softening point of 150° C.

EXAMPLE 1

A mixture of 40 pbw polyester resin L1, 60 pbw polyester resin H1, 1 pbw polyethylene wax (800P; Mitsui Sekiyu Kagaku Kogyo; melt viscosity 5400 cps at 160° C., softening point: 140° C.), 3 pbw oxidized polypropylene wax (TS-200; Sanyo Kasei Kogyo; melt viscosity of 120 cps at 160° C., softening point: 145° C. acid value: 3.5 KOHmg/g), 8 pbw acidic carbon black (Mogul L; Cabot; pH2.5, mean primary particle size: 24 nm), and 1.5 pbw negative charge controller having the chemical structural formula below

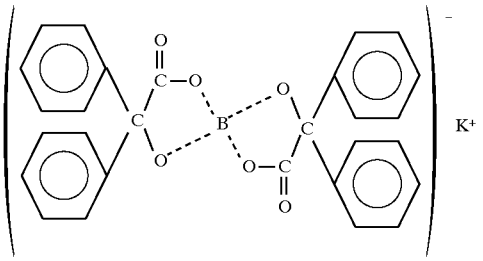

were added to a Henschel mixer and thoroughly mixed. The obtained mixture was fusion kneaded using a twin-shaft extrusion kneader, then cooled. The cooled mixture was coarsely pulverized using a hammer mill, and the coarsely pulverized material was finely pulverized using a jet mill, and then the material was then classified to obtain toner particles having a volume-average particle size of 7.5 $\mu$m.

These toner particles were mixed with 0.4 wt % hydrophobic silica microparticles having a BET specific surface area of 140 $m^2/g$ (H2000; Hoechst), and 0.2 wt % hydrophobic titanium dioxide microparticles having a BET specific surface area of 110 $m^2/g$ (STT30A; Chitan Kogyo) to obtain the end toner.

EXAMPLE 2

Toner was produced in the same manner as in Example 1 with the exception that 60 pbw of polyester resin L1 and 40 pbw polyester resin H1 were used.

EXAMPLE 3

Toner was produced in the same manner as in Example 1 with the exception that 50 pbw of polyester resin L4 was substituted for polyester resin L1, 50 pbw polyester resin H4 was substituted for polyester resin H1, the polyethylene wax was changed to 1.5 pbw 800P (Mitsui Sekiyu Kagaku) and 400P (Mitsui Sekiyu Kagaku) (melt viscosity 2000 cps at 160° C., softening point: 130° C.), the amount of added polypropylene wax was changed to 2.5 pbw, and 3 pbw Bontron S-34 (Orient Chemical Industries) was used as a negative charge controller.

EXAMPLE 4

Toner was produced in the same manner as in Example 1 with the exception that the amount of added polyethylene was as changed to 0.5 pbw.

EXAMPLE 5

Toner was produced in the same manner as in Example 1 with the exception that the melt blend polypropylene wax A was used in place f the oxidized polypropylene TS-200.

EXAMPLE 6

Toner was produced in the same manner as Example 5 with the exception that the amount of added polyester resin L1 was changed to 60 pbw, the amount of added polyester resin H1 was changed to 40 pbw, the polyethylene wax was changed to 1.5 pbw 400P (Mitsui Sekiyu Kagaku) (Mitsui Sekiyu Kagaku)(melt viscosity 1600 cps at 160° C., softening point: 136° C.), the polypropylene wax was changed to melt blend polypropylene wax B, and 3 pbw Bontron S-34 (Orient Chemical Industries) was used as a negative charge controller.

EXAMPLE 7

Toner was produced in the same manner as in Example 5 with the exception that 50 pbw polyester resin L4 was substituted for polyester resin L1, 50 pbw polyester resin H4 was substituted for polyester resin H1, and 3 pbw Bontron S-34 (Orient Chemical Industries) was used as a negative charge controller.

EXAMPLE 8

Toner was produced in the same manner as in Example 5 with the exception that the amount of added polyethylene wax was changed to 0.5 pbw.

REFERENCE EXAMPLE 1

Toner was produced in the same manner as in Example 3 with the exception that the amount of added polyethylene wax was changed to 2 pbw, and polypropylene wax was not added.

REFERENCE EXAMPLE 2

Toner was produced in the same manner as in Example 3 with the exception that the amount of added polypropylene wax was changed to 3.5 pbw, and polyethylene wax was not added.

REFERENCE EXAMPLE 3

Toner was produced in the same manner as in Example 3 with the exception that the polyethylene wax was changed to 1 pbw 800P (Mitsui Sekiyu Kagaku),. and the polypropylene wax was changed to 3 pbw Biscol 330P (Sanyo Kasei Kogyo) (melt viscosity: 4000 cps at 160° C.; softening point: 152° C.; acid value: 0 KOHmg/g).

REFERENCE EXAMPLE 4

Toner was produced in the same manner as in Example 3 with the exception that the polyethylene wax was changed to 1 pbw 410P (Mitsui Sekiyu Kagaku; melt viscosity: 500 cps at 160° C.; softening point: 122° C.), and the amount of added polypropylene wax was changed to 3 pbw.

REFERENCE EXAMPLE 5

Toner was produced in the same manner as in Example 1 with the exception that 100 pbw styrene-acrylic resin (MX-9500; Sanyo Kasei Kogyo) was substituted for the polyester resin L1 and the polyester resin H1.

REFERENCE EXAMPLE 6

Toner was produced in the same manner as in Example 3 with the exception that the polypropylene wax was changed to 3 pbw Yumex 1010 (Sanyo Kasei Kogyo; melt viscosity: 7000 cps at 160° C.; softening point: 145° C.; acid value: 52 KOHmg/g).

Each of the aforesaid toners were mixed with a pure carrier at a toner-to-carrier weight ratio of 5:95 to produce developer which was used in a digital copier (model Di30; Minolta Co., Ltd.). The toners were evaluated and the evaluation results are shown in Table 1.

ANTI-OFFESET CHARACTERISTICS

Solid images (2×5 cm) with an image density of 1.4 were formed while the fixing temperature was sequentially varied using a digital copier model Di30 modified with a fixing device which allowed variable fixing temperatures. The obtained images were visually examined and the temperature at which high-temperature offset occurred was noted. A high temperature offset temperature of 240° C. or higher was ranked ○, 220° C. and higher but less than 240° C. was ranked Δ, and less than 220° C. was ranked X.

SMEAR CHARACTERISTICS (SOILING BY RUBBING)

Using a digital copier model Di30, a solid image (2×5 cm) with an image density of 1.4 was formed on a sheet, a blank sheet was overlaid on the image and a load of 200 g was applied; the process was repeated three times. The soiling of the image was visually evaluated; the complete absence of soiling was ranked ○, slight soiling that posed no practical problem was ranked Δ, and severe soiling the precluded practical use was ranked X.

FILMING AND BLACK SPOTS

Using a model Di30 digital copier, 120,000 printings were made and evaluated. Thereafter, the surface of the photosensitive member was visually evaluated for the presence/absence of filming (i.e., glossiness of the surface of the photosensitive member is eliminated when filming occurs) and the presence/absence of adhered toner components. The absence of both filming and black spots was ranked ○, the occurrence of either filming or black spots or both was ranked X.

DOT REPRODUCIBILITY

Dot images of 2×2 dots (400 dpi) were formed using a modified model Di30 digital copier with the fixing roller temperature set at 180° C. The dot image diameter of obtained dot images was measured using an image analysis device to produce data for about 80–100 dots to determine the maximum diameter value Dmax. Rankings are described below. Dmax of less than 185 μm was designated rank 10, 185 μm and higher but less than 187.5 μm was designated rank 9, 197.5 μm and higher but less than 190 μm was designated rank 8, 190 μm and higher but less than 192.5 μm was designated rank 7, 192.5 μm and higher but less than 195 μm was designated rank 6, 195 μm and higher but less than 197.5 was designated rank 5. Ranks 9 and 10 are expressed by O, ranks 7 and 8 are expressed by Δ, and ranks 6 and below are expressed by X.

TABLE 1

| | Anti-offset | Smear resistance | Filming-Black Spot | Dot Reproducibility |
|---|---|---|---|---|
| Ex 1 | ○ | ○ | ○ | ○ |
| Ex 2 | ○ | ○ | ○ | Δ |
| Ex 3 | Δ | ○ | ○ | Δ |
| Ex 4 | ○ | Δ | ○ | ○ |
| Ex 5 | ○ | ○ | ○ | ○ |
| Ex 6 | ○ | ○ | ○ | Δ |
| Ex 7 | ○ | ○ | ○ | Δ |
| Ex 8 | ○ | Δ | ○ | ○ |
| Ref 1 | x | x | ○ | Δ |
| Ref 2 | Δ | x | ○ | Δ |
| Ref 3 | Δ | Δ | x | Δ |

TABLE 1-continued

| | Anti-offset | Smear resistance | Filming-Black Spot | Dot Reproducibility |
|---|---|---|---|---|
| Ref 4 | Δ | x | x | Δ |
| Ref 5 | Δ | x | x | x |
| Ref 6 | x | ○ | x | Δ |

EXAMPLE 9

Toner was produced in the same manner as in Example 1 with the exception that 3 pbw oxidized polypropylene wax (TS-200) was changed to 2 pbw oxidized polypropylene wax (100TS; Sanyo Kasei Kogyo; melt viscosity: 120 cps at 160° C.; softening point: 144° C.; acid value: 3.5 KOHmg/g), 8 pbw carbon black (Mogul L) was changed to 8 pbw carbon black (Black Pearls L; Cabot; pH2.5; mean primary particle size: 24 nm), and 2 pbw negative charge controller was used.

EXAMPLE 10

Toner was produced in the same manner as in Example 9 with the exception that 50 pbw polyester resin L2 was substituted for polyester resin L1, 50 pbw polyester resin H2 was substituted for polyester resin H1, 3 pbw chrome-containing azo dye (Bontron S-34; Orient Chemical Industries) was used as a negative charge controller, and the amount of added carbon black was changed to 6 pbw.

EXAMPLE 11

Toner was produced in the same manner as in Example 9 with the exception that 70 pbw polyester resin L2 was substituted for polyester resin L1, 30 pbw polyester resin H3 was substituted for polyester resin H1, the amount of added negative charge controller was changed to 1.5 pbw, and 6 pbw Monarch 1300 (Cabot; pH2.5; mean primary particle size: 13 nm) was added as carbon black.

EXAMPLE 12

Toner was produced in the same manner as in Example 9 with the exception that 30 pbw polyester resin L3 was substituted for polyester resin L1, 70 pbw polyester resin H2 was substituted for polyester resin H1, 3 pbw zinc salicylate complex salt (E-84; Orient Chemical Industries) was used as a negative charge controller, and the 10 pbw Mogul L (Cabot; pH2.5; mean primary particle size: 24 nm) was used as carbon black.

EXAMPLE 13

Toner was produced in the same manner as in Example 9 with the exception that 50 pbw polyester resin L3 was substituted for polyester resin L1, 50 pbw polyester resin H3 was substituted for polyester resin H1, the amount of added negative charge controller was changed to 1 pbw, and the 12 pbw Regal 330 (Cabot; pH9.0; mean primary particle size: 25 nm) was added as carbon black.

Each of the aforesaid toners were mixed with a pure carrier at a toner-to-carrier weight ratio of 5:95 to produce developer which was used in a digital copier (model Di30; Minolta Co., Ltd.). The toners were evaluated and the evaluation results are shown in Table 2.

ANTI-OFFSET CHARACTERISTICS

Solid images (2×5 cm) with an image density of 1.4 were formed while the fixing temperature was sequentially varied using a digital copier model Di30 modified with a fixing device which allowed variable fixing temperatures. The obtained images were visually examined and the temperatures at which low-temperature offset and high-temperature offset occurred was noted (the range between low-temperature offset and high-temperature offset is the anti-offset range).

FIXING STRENGTH

Solid images were formed using a model Di30 digital copier. An eraser was applied three times across the image at a load of 1 kg; image density before and after this process was measured using a MacBeath reflective densitomer, and the fixing strength was calculated via the equation {(post-test image density/pre-test image density)×100}.

DOT REPRODUCIBILITY

Dot images of 2×2 dots (400 dpi) were formed using a modified model Di30 digital copier with the fixing roller temperature set at 180° C. The dot image diameter of obtained dot images was measured using an image analysis device to produce data for about 80–100 dots to determine the maximum diameter value Dmax. Rankings are described below. Dmax of less than 185 μm was designated rank 10, 185 μm and higher but less than 187.5 μm was designated rank 9, 197.5 μm and higher but less than 190 μm was designated rank 8, 190 μm and higher but less than 192.5 μm was designated rank 7, 192.5 μm and higher but less than 195 μm was designated rank 6, 195 9 and higher but less than 197.5 was designated rank 5. Ranks 9 and 10 are expressed by O, ranks 7 and 8 are expressed by Δ, and ranks 6 and below are expressed by X.

TABLE 2

| | Low-temp offset (°C.) | High-temp offset (°C.) | Fixing Strength (%) | Dot Reproducibility |
|---|---|---|---|---|
| Ex 9 | 132 | 230 | 85 | ○ |
| Ex 10 | 128 | 200 | 90 | ○ |
| Ex 11 | 130 | 215 | 87 | Δ |
| Ex 12 | 132 | 220 | 85 | ○ |
| Ex 13 | 126 | 230 | 89 | ○ |

What is claimed is:

1. A toner for developing electrostatic latent images comprising:

a binder resin comprising a first resin and a second resin; and a colorant;

said first resin having a softening point of 95° to 120° C. and a glass transition point of 50° to 75° C., said second resin having a softening point of 130° to 160° C. and a glass transition point of 50° to 75° C., said first resin comprising a linear polyester resin obtained by a bivalent alcohol component and a bivalent carboxylic acid component, said second resin obtained by a raw monomer of the polyester resin, a raw monomer of the vinyl resin and a dual-reactive monomer, and said dual-reactive monomer being a raw monomer that is able to use dual reactions of a condensation polymerization and a radical polymerization.

2. The toner of claim 1, wherein the binder resin has an acid value of 5 to 50 KOHmg/g.

3. The toner of claim 1, wherein a weight ratio of the first resin to the second resin is 7:3 to 2:8.

4. The toner of claim 1, wherein the first resin comprises a bisphenol-A alkylene oxide additive as the bivalent alcohol component and at least one bivalent carboxylic acid monomer selected from the group consisting of a terephthalic acid, a fumaric acid and a dodecenylsuccinic acid as the bivalent carboxylic acid component.

5. The toner of claim 1, wherein the dual-reactive monomer has a carboxyl group and a vinyl group.

6. The toner of claim 1, wherein an amount of the vinyl resin of the second resin is from 5 to 40 percent by weight on the basis of the second resin.

7. The toner of claim 1, comprising a polyethylene wax and a polypropylene wax, said polyethylene wax having a melt viscosity of 1,000 to 8,000 cps at 160° C. and a softening point of 130° to 150° C., and said polypropylene wax having a melt viscosity of 50 to 300 cps at 160° C., a softening point of 130° to 160° C. and an acid value of 1 to 20 KOHmg/g.

8. The toner of claim 1, wherein the colorant is a carbon black containing an amount of 6 to 12 parts by weight per 100 parts by weight of the binder resin.

9. The toner of claim 8, wherein the carbon black has a pH value of 1 to 6.

10. The toner of claim 8, wherein the carbon black has a mean primary particle size of 10 to 40 nm.

11. The toner of claim 1, comprising a negative charge controlling agent which is contained in an amount of 0.5 to 5 parts by weight per 100 parts by weight of the binder resin.

12. The toner of claim 11, wherein the charge controlling agent is a boron compound represented by a structural formula (A):

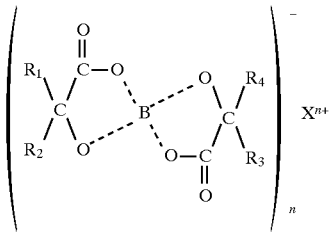

(A)

wherein $R_1$ and $R_3$ respectively are selected from the group consisting of substituted and non-substituted aryl group, $R_2$ and $R_4$ respectively are selected from the group consisting of hydrogen atom, alkyl group, and substituted or non-substituted aryl group, X represents a cation, and n is an integer of either 1 or 2.

13. The toner of claim 1, comprising magnetic particles which is contained in an amount of 0.5 to 10 parts by weight per 100 parts by weight of the binder resin.

* * * * *

UNITED STATES PATENT AND TRADEMARK OFFICE

CERTIFICATE OF CORRECTION

PATENT NO. : 5,853,940
DATED : December 29, 1998
INVENTOR(S) : Kido et al.

It is certified that error appears in the above-identified patent and that said Letters Patent is hereby corrected as shown below:

On the title page,

Under "Foreign Application Priority Data", change [1919] to --1997--.

Signed and Sealed this

Eleventh Day of May, 1999

*Attest:*

Q. TODD DICKINSON

*Attesting Officer*

*Acting Commissioner of Patents and Trademarks*